US006375556B1

(12) United States Patent
Wenger

(10) Patent No.: US 6,375,556 B1
(45) Date of Patent: Apr. 23, 2002

(54) GRINDING APPARATUS FOR GRINDING WORKPIECES

(76) Inventor: Fritz L. Wenger, N3193 Aebly Rd., Monroe, WI (US) 53566

( * ) Notice: Subject to any disclaimer, the term of this patent is extended or adjusted under 35 U.S.C. 154(b) by 0 days.

(21) Appl. No.: 09/149,648

(22) Filed: Sep. 8, 1998

(51) Int. Cl.[7] ..... B24B 47/02

(52) U.S. Cl. ..... 451/331; 451/332; 451/334; 451/403; 451/143

(58) Field of Search ..... 451/332, 334, 451/403, 143, 142, 5, 14, 331

(56) References Cited

U.S. PATENT DOCUMENTS

| | | | |
|---|---|---|---|
| 4,601,133 A | | 7/1986 | Dippold et al. |
| 5,035,088 A | * | 7/1991 | Putnam et al. |
| 5,480,343 A | * | 1/1996 | Pedersen et al. |
| 5,679,060 A | * | 10/1997 | Leonard et al. |
| 5,685,768 A | | 11/1997 | Bernhard et al. |
| 5,857,894 A | * | 1/1999 | Griesbach et al. |

FOREIGN PATENT DOCUMENTS

| | | |
|---|---|---|
| JP | 9155738 A | 6/1997 |
| JP | 9314446 A | 12/1997 |
| WO | WO9738822 A1 | 10/1997 |

* cited by examiner

*Primary Examiner*—Timothy V. Eley
*Assistant Examiner*—Willie Berry, Jr.
(74) *Attorney, Agent, or Firm*—David J. Archer

(57) ABSTRACT

The apparatus includes a frame and a holder rotatably secured to the frame for releasably holding a first workpiece of the workpieces. A mechanism is provided for rotating the holder from a loading station to a grinding station and a grinder is movably secured to the frame and selectively positionable relative to the first workpiece when the first workpiece is located at the grinding station. A control is included for selectively positioning the grinding means relative to the first workpiece for grinding the first workpiece and a further holder is rigidly secured to and spaced relative to the holder. The arrangement is such that when the holder is rotated in a direction towards the grinding station, the further holder is rotated in a direction towards the loading station for loading a second workpiece of the workpieces at the loading station so that sequential grinding and loading of the workpieces is permitted.

15 Claims, 8 Drawing Sheets

GRINDING APPARATUS FOR GRINDING WORKPIECES

BACKGROUND OF THE INVENTION

1. Field of the Invention

The present invention relates to a grinding apparatus for grinding workpieces. More specifically, the present invention relates to a grinding apparatus for remotely grinding workpieces such as metal castings.

2. Information Disclosure Statement

When metal castings are made, such castings include burrs, risers, parting lines or flow offs that make it necessary for an operator to manually grind such flaws from the casting.

Accordingly, a grinder must secure the casting so that such metal casting can be manually ground by means of a rotary grinding wheel or the like.

During the grinding operation, the operator must reorient and secure the workpiece several times in order to gain access to the various facets of the casting. Therefore, the grinding operation becomes a labor intensive step in the manufacture of a machined end product.

Additionally, during the grinding operation, a considerable amount of powdered metal is generated in the vicinity of the grinding process and such dust which becomes ferric oxide presents a considerable health hazard to the grinder and other personnel working in the grinding shop.

Furthermore, because some of the castings weigh up to 600 lb., many grinder operators suffer from back problems and Carpal Tunnel Syndrome and other heath problems. Consequently, it is not unusual for a grinding shop to have a workforce having an average employment stay of less than six months.

Therefore, due to the rapid employment turnover of grinding personnel, the quality of the resultant ground casting is often less than desired.

The present invention overcomes all of the aforementioned problems associated with the prior art arrangements by providing a machine which permits loading of a workpiece and rotation of the workpiece to a grinding location where the workpiece can be remotely manipulated during the grinding process by an operator operating remote control grinding equipment.

Therefore, it is a primary objective of the present invention to provide an apparatus which overcomes the aforementioned problems associated with the prior manual grinding operations and which makes a considerable contribution to the art of grinding castings.

Also, an object of the present invention is the control of dust generated by the grinding operation.

Another objective of the present invention is the provision of an apparatus for grinding castings to a premachining standard.

Other objects and advantages of the present invention will be readily apparent to those skilled in the art by a consideration of the detailed description of a preferred embodiment of the present invention contained hereinafter taken in conjunction with the annexed drawings.

SUMMARY OF THE INVENTION

The present invention relates to an apparatus and method for grinding workpieces. The apparatus includes a frame and a holder rotatably secured to the frame for releasably holding a first workpiece of the workpieces.

Means for rotating the holder from a loading station to a grinding station and grinding means movably secured to the frame and selectively positionable relative to the first workpiece when the first workpiece is located at the grinding station.

Control means for selectively positioning the grinding means relative to the first workpiece for grinding the first workpiece and a further holder rigidly secured to and spaced relative to the holder. The arrangement is such that when the holder is rotated in a direction towards the grinding station, the further holder is rotated in a direction towards the loading station for loading a second workpiece of the workpieces at the loading station so that sequential grinding and loading of the workpieces is permitted.

In a more specific embodiment of the present invention the frame includes a base and a vertical support extending upwardly from the base.

A housing is rotatably supported relative to the vertical support such that the housing rotates about a vertical axis for permitting movement of the workpieces between the loading and the grinding stations.

The frame also includes a first and a second sidewall extending upwardly from the base and a grinder support extending between the sidewalls for supporting the grinding means.

Additionally, the frame includes a cab rigidly secured to the base.

The holder extends radially outwards from the housing, the holder including a first arm rotatably connected to the housing such that the first arm rotates about a horizontal axis.

Also, the first arm has a proximal end adjacent to the housing and a distal end.

A second arm is extendably connected to the first arm, the second arm having a first end which slidably cooperates with the proximal end of the first arm. A second end of the second arm cooperates with the distal end of the first arm such that when the arms are located at the grinding station, the first workpiece is held between the distal end of the first arm and the second end of the second arm so that the accommodation of different size workpieces is permitted and rotation of the first workpiece about the horizontal axis is permitted.

The first arm also includes an anchor rotatably secured to the distal end thereof.

Furthermore, the second arm includes a further anchor rotatably secured to the second end thereof.

A drive means is drivingly connected to at least one of the anchors such that when the first workpiece is disposed between the anchors with the first workpiece being held between the arms, rotation of the first workpiece about a further axis extending between the anchors is permitted.

More particularly, the drive means is drivingly connected to at least one of the anchors such that when the first workpiece is disposed between the anchors with the first workpiece being held between the arms, rotation of the first workpiece about a further axis extending between the anchors is permitted when the first workpiece is disposed in both the grinding and the loading station. The arrangement is such that controlled movement of the first workpiece about a combination of the vertical, horizontal and further axes is permitted, so that accurate location of the first workpiece relative to the grinding means is readily attained.

The means for rotating the holder includes a motor and a drive transmission connected to the motor for driving the housing about the vertical axis.

The grinding means also includes a depending arm supported by the grinder support.

The grinder support includes a first and a second transverse rail, each rail extending between the sidewalls.

A carriage is supported and guided by the rails such that movement of the carriage between the sidewalls is permitted.

A screw and block mechanism is mounted on the carriage such that the block supports the depending arm for permitting movement of the depending arm in a first direction between the sidewalls and in a second direction normal to the first direction.

Lifting means is connected to the depending arm for permitting vertical movement of the depending arm relative to the carriage so that movement of the depending arm to any location is permitted.

The grinding means is rotatably secured to the depending arm.

The control means includes electronic circuits for controlling both the movement and positioning of the workpieces disposed at the loading and grinding stations and movement of the grinding means relative to the first workpiece at the grinding station.

In an alternative embodiment of the present invention, the control means includes hydraulic servo circuits for controlling both the movement and positioning of the workpieces disposed at the loading and grinding stations and movement of the grinding means relative to the first workpiece at the grinding station.

In a preferred embodiment of the present invention, the further holder is disposed diametrically opposite to the holder, the arrangement being such that in operation of the apparatus, a first operator receives and loads the first workpiece onto the further holder. The first workpiece is rotated to the grinding station and subsequently, a second operator remotely controls both the orientation of the first workpiece and remotely adjusts the position of the grinding means relative to the first workpiece for carrying out a grinding operation thereon. Such grinding operation is performed while the first operator loads the second workpiece at the loading station.

On completion of the grinding operation, the first workpiece is rotated to the loading station where the first operator inspects, hand grinds if necessary and unloads the first workpiece while the second workpiece is being ground remotely by the second operator.

Preferably, the cab further includes an air conditioning system.

Many modifications and variations of the present invention will be readily apparent to those skilled in the art by a consideration of the detailed description of a preferred embodiment of the present invention contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
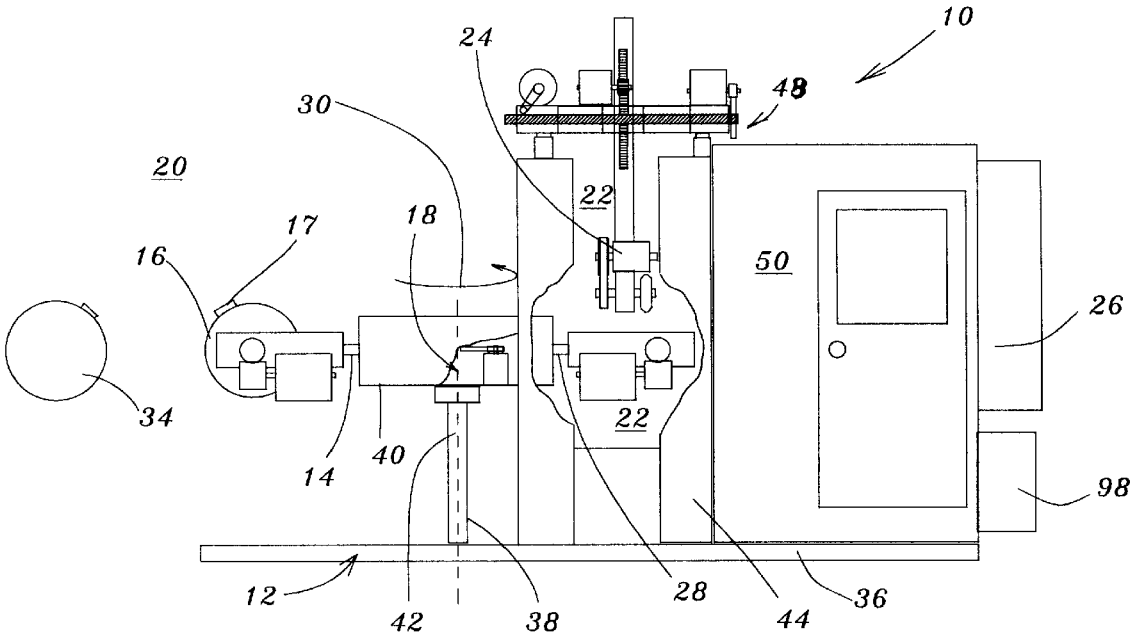
FIG. 1 is a side elevational view of a grinding apparatus according to the present invention.

FIG. 1. is a side elevational view of an apparatus for grinding workpieces. The apparatus generally designated 10 includes a frame generally designated 12 and a holder 14 rotatably secured to the frame 12 for releasably holding a first workpiece 16 of the workpieces.

The workpiece 16 is shown as having a burr 17 which must be ground from the casting 16.

Means generally designated 18 are provided for rotating the holder 14 from a loading station 20 to a grinding station 22. Also, grinding means 24 is movably secured to the frame 12 and selectively positionable relative to the first workpiece 16 when the first workpiece 16 is rotated to and located at the grinding station 22.

Figure 2:
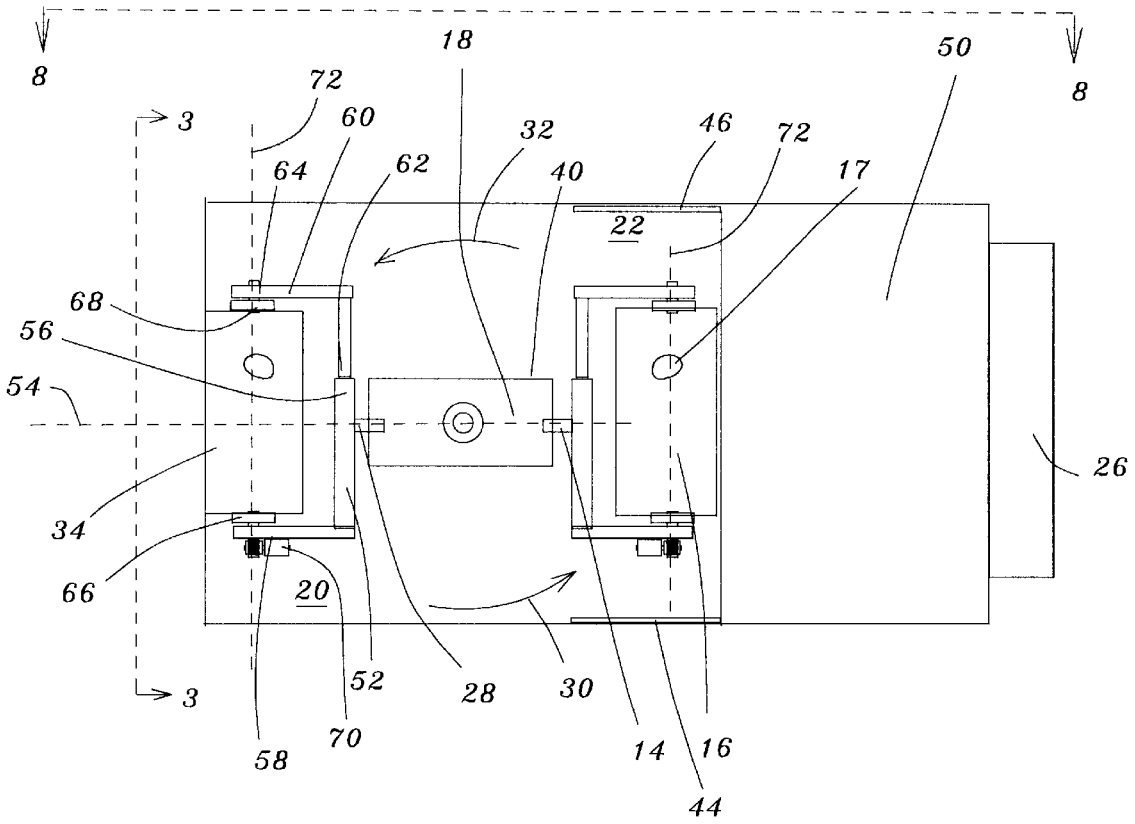
FIG. 2 is a top plan view of the grinding apparatus shown in FIG. 1.

FIG. 2 is a top plan view of the apparatus shown in FIG. 1. FIG. 2 shows control means 26 which are used for selectively positioning the grinding means 24 relative to the first workpiece 16 for grinding the first workpiece 16 when the workpiece is at the grinding station 22 as shown in FIG. 2. A further holder 28 is secured to and spaced relative to the holder 14. The arrangement is such that when the holder 14 is rotated in a direction as indicated by the arrow 30 towards the grinding station 22 as shown in FIG. 2, the further holder 28 is rotated in a direction as indicated by the arrow 32 towards the loading station 20 for loading a second workpiece 34 of the workpieces at the loading station 20 so that sequential grinding and loading of the workpieces 16 and 34 is permitted.

The frame

More specifically, the frame 12 includes a base 36 shown in FIG. 1 and a vertical support 38 extending upwardly from the base 36.

As shown in FIGS. 1 and 2, a housing 40 is rotatably supported relative to the vertical support 38 such that the housing 40 rotates about a vertical axis 42 for permitting movement of the workpieces 16 and 34 between the loading and the grinding stations 20 and 22 respectively.

The frame 12 also includes a first and a second sidewall 44 and 46 respectively extending upwardly from the base 36 and a grinder support 48 extending between the sidewalls 44 and 46 for supporting the grinding means 24.

Additionally, the frame 12 includes a cab 50 rigidly secured to the base 36.

The Holder

FIG. 2 shows the holder 14 which extends radially outwards from the housing 40. The holder 14 the same as the further holder 28 includes a first arm 52 rotatably connected to the housing 40 such that the first arm 52 rotates about a horizontal axis 54.

Also, the first arm 52 has a proximal end 56 adjacent to the housing 40 and a distal end 58.

Figure 3:
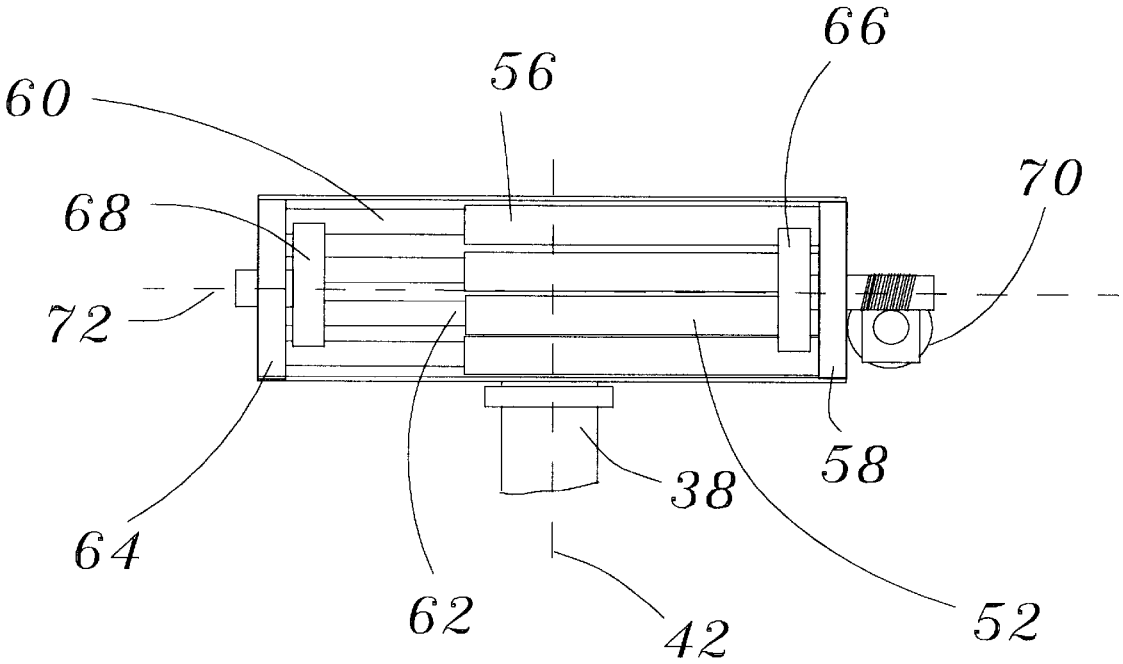
FIG. 3 is an enlarged view taken on the line 3—3 of FIG. 2.

FIG. 3 is an enlarged view taken on the line 3—3 of FIG. 2 but with the workpiece 34 removed for clarity. FIG. 3 shows a second arm 60 which is extendably connected to the first arm 52, the second arm 60 having a first end 62 which slidably cooperates with the proximal end 56 of the first arm 52. A second end 64 of the second arm 60 cooperates with the distal end 58 of the first arm 52 such that when the arms 52 and 60 are rotated as indicated by the arrows 30 and 32, the arms 52 and 60 are moved to the grinding station 22.

Accordingly, the workpiece is held between the distal end 58 of the first arm 52 and the second end 64 of the second arm 60 so that the accommodation of different size workpieces is permitted and rotation of the workpieces 16 and 34 about the horizontal axis 54 as shown in FIG. 2 is permitted.

The first arm 52 also includes an anchor 66 rotatably secured to the distal end 58 thereof .

Furthermore, the second arm 60 includes a further anchor 68 rotatably secured to the second end 64 thereof.

A drive means 70 is drivingly connected to at least one of the anchors 66 or 68 such that when a workpiece is disposed between the anchors 66 and 68 with the workpiece being held between the arms 52 and 60, rotation of the workpiece about a further axis 72 extending between the anchors 66 and 68 is permitted.

More particularly, the drive means 70 is drivingly connected to at least one of the anchors 66 or 68 such that when a workpiece is disposed between the anchors 66 and 68 with the workpiece being held between the arms 52 and 60, rotation of the workpiece about the further axis 72 extending between the anchors 66 and 68 is permitted when the workpiece is disposed in either the grinding or the loading station 22 and 20 respectively. The arrangement is such that controlled movement of the workpiece about a combination of the vertical, horizontal and further axes 42, 54 and 72 respectively is permitted, so that accurate location of the first workpiece 16 relative to the grinding means 24 is readily attained.

The Means for Rotating the Holder

Figure 4:
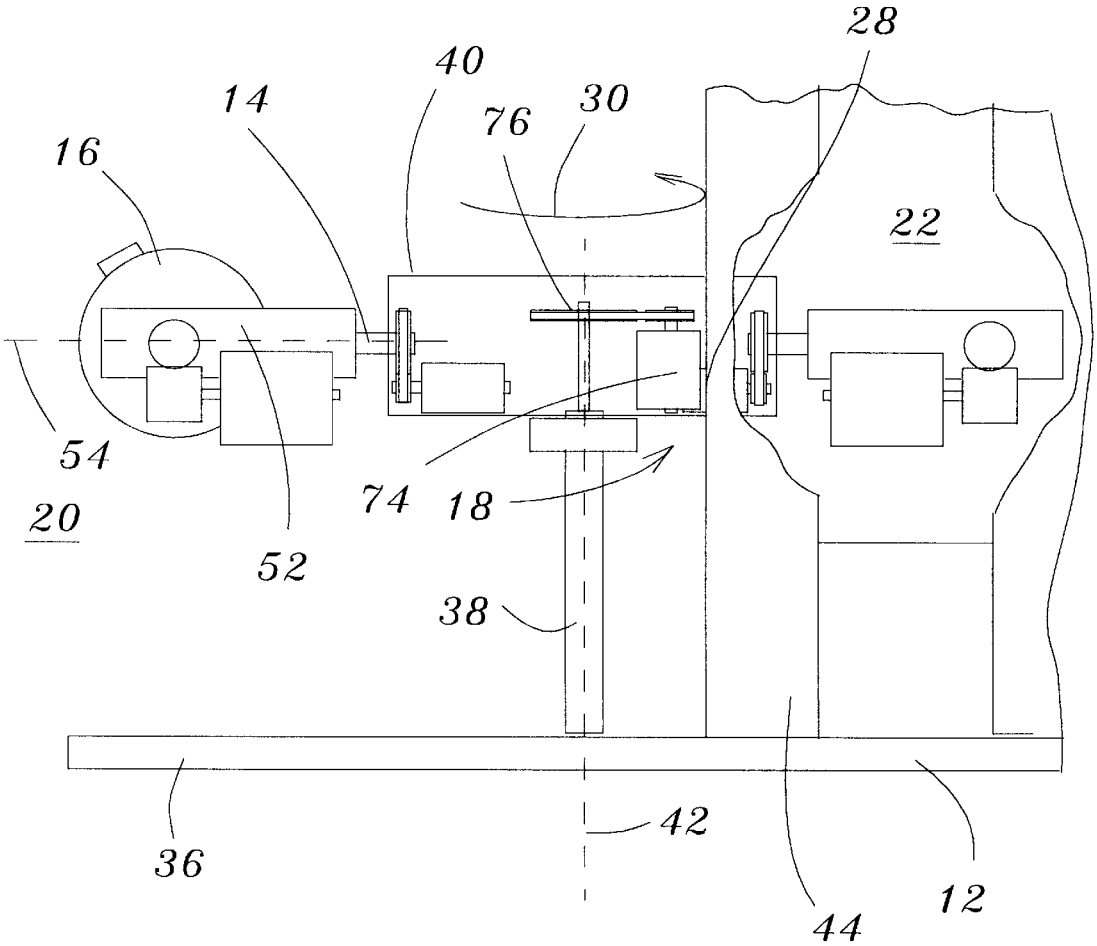
FIG. 4 is an enlarged side elevational view of the means for rotating the holder.

FIG. 4 is an enlarged side elevational view of particularly the means for rotating the holder.

The means generally designated 18 which is for rotating the holder 14 and further holder 28 includes a motor 74 and a drive transmission 76 connected to the motor 74 for driving the housing 40 about the vertical axis 42.

The Grinding Means

Figure 5:
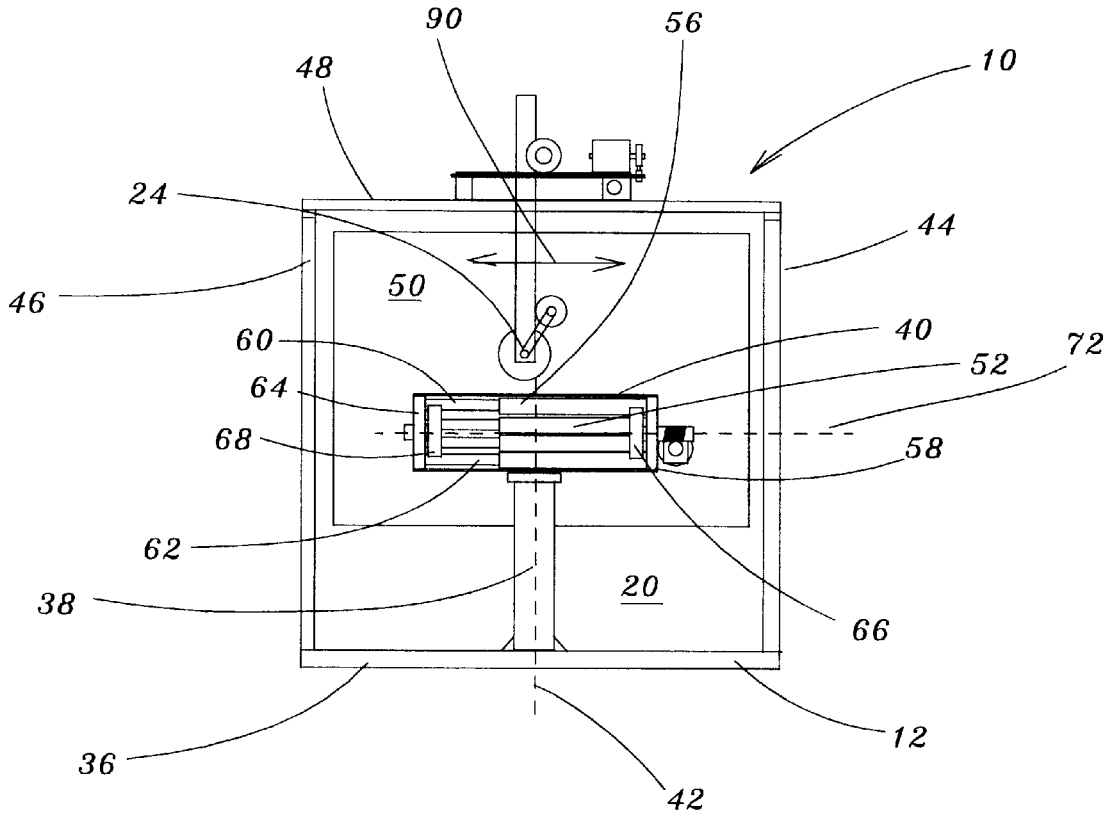
FIG. 5 is a view taken from the left side of the apparatus shown in FIG. 1.

FIG. 5 is a view taken from the left side of the apparatus shown in FIG. 1 but with the workpieces removed for clarity.

Figure 6:
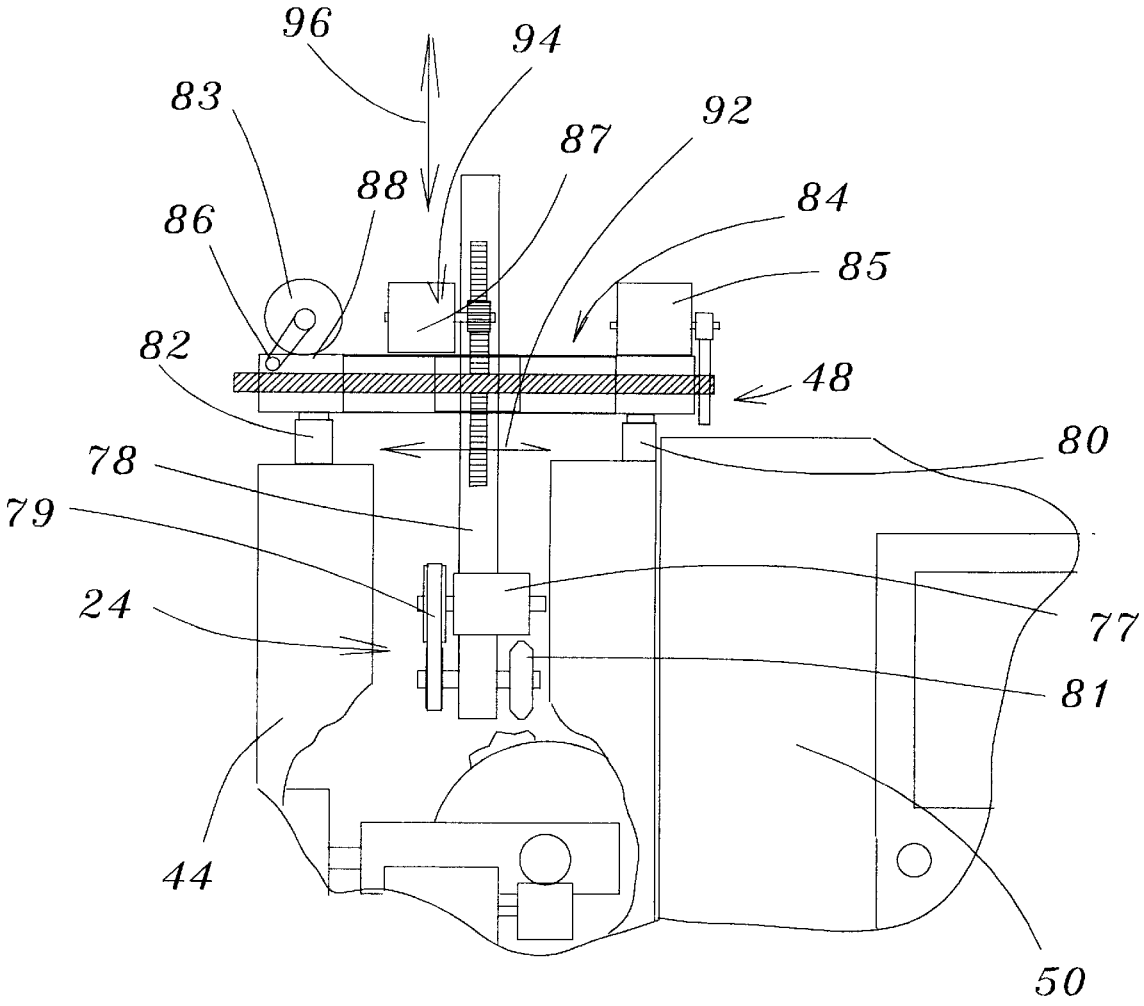
FIG. 6 is an enlarged view of the grinding means.

FIG. 6 is an enlarged view of the grinding means shown in FIG. 1. FIG. 6 shows the grinding means 24 as also including a depending arm 78 supported by the grinder support 48.

The grinder support 48 includes a first and a second transverse rail 80 and 82 respectively, each rail 80 and 82 extending between the sidewalls 44 and 46.

A carriage generally designated 84 is supported and guided by the rails 80 and 82 such that movement of the carriage 84 between the sidewalls 44 and 46 is permitted.

A screw 86 and block mechanism 88 is mounted on the carriage 84 such that the block 88 supports the depending arm 78 for permitting movement of the depending arm 78 in a first direction as indicated by the arrow 90 between the sidewalls 44 and 46 as shown in FIG. 5 and in a second direction as indicated by the arrow 92 normal to the first direction 90.

Lifting means generally designated 94 is connected to the depending arm 78 for permitting vertical movement of the depending arm 78 relative to the carriage 84, as indicated by the arrow 96, so that movement of the depending arm 78 to any location is permitted.

The grinding means 24 is rotatably secured to the depending arm 78. The grinding means 24 includes a motor 77, a drive arrangement 79 and a grinding wheel 81.

The Control Means

The control means 26 shown in FIG. 1 includes electronic circuits (not shown) for controlling both the movement and positioning of the workpieces 16 and 34 disposed at the loading and grinding stations 20 and 22, rotation of the holders 14, and 28, rotation of the workpieces about axis 72 and movement of the grinding means 24 relative to the first workpiece 16 at the grinding station 22. Such movement of the grinding means includes movement in the various directions as indicated by arrows 90, 92 and 96 by means of motors 83, 85 and 87 respectively.

Although an electronic control means is shown in the preferred embodiment it will be understood by those skilled in the art that alternatively, the control means could include hydraulic servo circuits or pneumatic means for controlling both the movement and positioning of the workpieces 16 and 34 disposed at the loading and grinding stations 20 and 22 and movement of the grinding means 24 relative to the first workpiece 16 at the grinding station 22.

The Further Holder.

Figure 7:
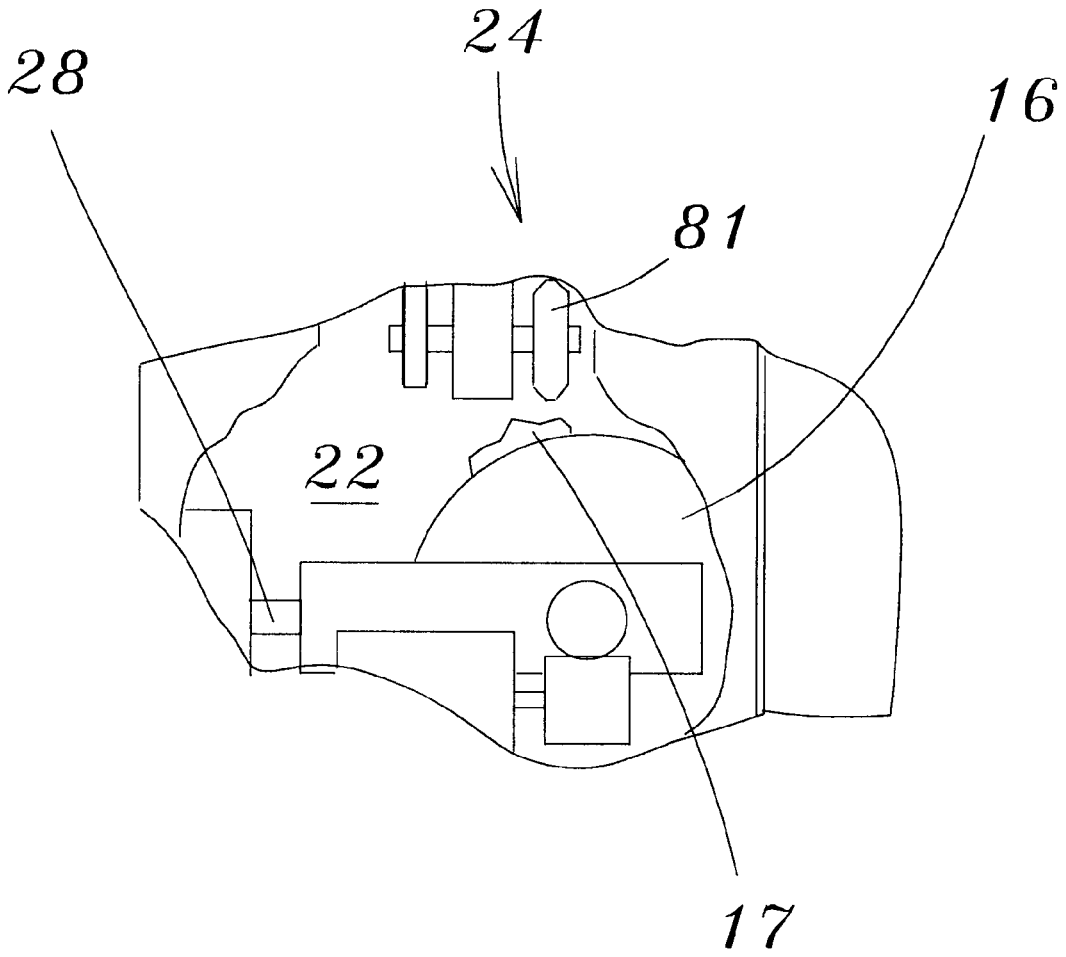
FIG. 7 is an enlarged view of the further holder.

FIG. 7 is an enlarged view of the further holder. FIG. 7 shows that in a preferred embodiment of the present invention, the further holder 28 is disposed diametrically opposite to the holder 14. The arrangement is such that in operation of the apparatus 10, a first operator receives and loads the first workpiece 16 onto the holder 14. The first workpiece 16 is rotated as indicated by arrow 30 to the grinding station 22 and subsequently, a second operator remotely controls both the orientation of the first workpiece 16 and remotely adjusts the position of the grinding means 24 relative to the first workpiece 16 for carrying out a grinding operation thereon. Such grinding operation is performed while the first operator loads the second workpiece 34 at the loading station 20.

On completion of the grinding operation, the first workpiece 16 is rotated as indicated by arrow 32 to the loading station 20 where the first operator inspects, hand grinds if necessary and unloads the first workpiece 16 while the second workpiece 34 is being ground remotely by the second operator at the grinding station 22.

Preferably, the cab 50 further includes an air conditioning system 98.

Figure 8:
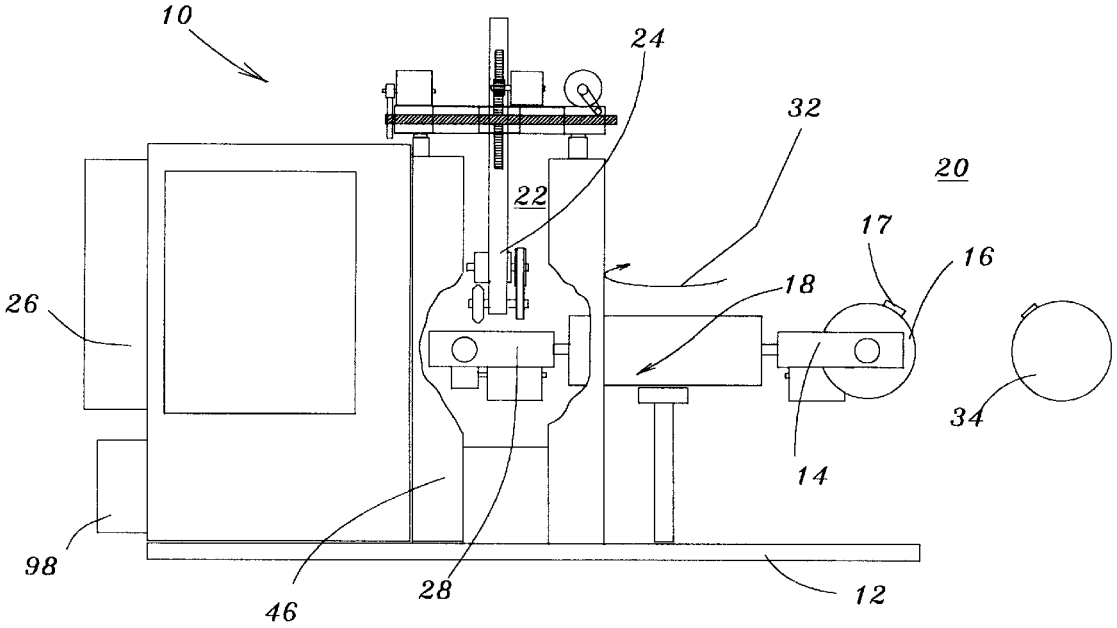
FIG. 8 is a view taken on the line 8—8 of FIG. 2.

FIG. 8 is a view taken on the line 8—8 of FIG. 2 and shows the opposite side of the apparatus relative to the view of FIG. 1.

The present invention enables the remote control of a grinder for grinding castings that overcomes the health hazards associate with manual grinding operations.

What is claimed is:

1. A grinding apparatus for grinding workpieces, said apparatus comprising:

a frame;

a holder rotatable secured to said frame for releasably holding a first workpiece of the work pieces:

means for rotating said holder from a loading station to a grinding station;

grinding means movably secured to said frame and selectively positionable relative to the first workpiece when the first workpiece is located at said grinding station;

control means for selectively positioning said grinding means relative to the first workpiece for grinding the first workpiece;

a further holder rigidly secured to and spaced relative to said holder, the arrangement being such that when said holder is rotated in a direction towards said grinding station, said further holder is rotated in a direction towards said loading station for loading a second workpiece of the workpieces at said loading station so that sequential grinding and loading of the workpieces is permitted;

said frame including:

a base;

a vertical support extending upwardly from said base;

a housing rotatably supported relative to said vertical support such that said housing rotates about a vertical axis for permitting movement of said workpieces between said loading and said grinding stations;

said holder extending radially outwards from said housing;

said holder including:

a first arm rotatably connected to said housing such that said first arm rotates about a horizontal axis;

said first arm having a proximal end adjacent to said housing and a distal end; and a second arm extendably connected to said first arm, said second arm having a first end which slidably cooperates with said proximal end of said first arm, and a second end which cooperates with said distal end of said first arm such that when said arms are located at said grinding station, said first workpiece is held between said distal end of said first arm and said second end of said second arm so that the accommodation of different size workpieces is permitted and rotation of said first workpiece about said horizontal axis is permitted.

2. A grinding apparatus as set forth in claim 1 wherein said frame includes;

a base;

a vertical support extending upwardly from said base;

a housing rotatably supported relative to said vertical support such that said housing rotates about a vertical axis for permitting movement of said workpieces between said loading and said grinding stations.

3. A grinding apparatus as set forth in claim 2 wherein said means for rotating said holder includes:

a motor;

a drive transmission connected to said motor for driving said housing about said vertical axis.

4. A grinding apparatus as set forth in claim 1 wherein said frame includes;

a base;

a first and a second sidewall extending upwardly from said base;

a grinder support extending between said sidewalls for supporting said grinding means.

5. A grinding apparatus as set forth in claim 1 wherein said frame includes;

a base;

a cab rigidly secured to said base.

6. A grinding apparatus as set forth in claim 5 wherein said cab further includes:

an air conditioning system.

7. A grinding apparatus as set forth in claim 1 wherein said first arm includes;

an anchor rotatably secured to said distal end thereof;

said second arm including:

a further anchor rotatably secured to said second end thereof, drive means drivingly connected to at least one of said anchors such that when said first workpiece is disposed between said anchors with said first workpiece being held between said arms, rotation of said first workpiece about a further axis extending between said anchors is permitted.

8. A grinding apparatus as set forth in claim 7 wherein said drive means is drivingly connected to at least one of said anchors such that when said first workpiece is disposed between said anchors with said first workpiece being held between said arms, rotation of said first workpiece about a further axis extending between said anchors is permitted when said first workpiece is disposed in both said grinding and said loading station, the arrangement being such that controlled movement of the first workpiece about a combination of said vertical, horizontal and further axes is permitted, so that accurate location of the first workpiece relative to said grinding means is readily attained.

9. A grinding apparatus as set forth in claim 1 wherein said control means includes:

electronic circuits for controlling both the movement and positioning of the workpieces disposed at the loading and grinding stations and movement of said grinding means relative to the first workpiece at said grinding station.

10. A grinding apparatus as set forth in claim 1 wherein said control means includes:

hydraulic servo circuits for controlling both the movement and positioning of the workpieces disposed at the loading and grinding stations and movement of said grinding means relative to the first workpiece at said grinding station.

11. A grinding apparatus as set forth in claim 1 wherein said further holder is disposed diametrically opposite to said holder.

12. A grinding apparatus as set forth in claim 1 wherein said further holder is disposed diametrically opposite to said holder, the arrangement being such that in operation of the apparatus, a first operator receives and loads said first workpiece onto said holder, said first workpiece being rotated to said grinding station, subsequently, a second operator remotely controls both the orientation of said first workpiece and subsequently remotely adjusts the position of said grinding means relative to said first workpiece for carrying out a grinding operation thereon, such grinding operation being performed while said first operator loads said second workpiece at said loading station.

13. A grinding apparatus as set forth in claim 12 wherein said means for rotating said holder to said loading station is a motor so that on completion of said grinding operation, said first workpiece is rotated to said loading station where said first operator inspects, hand grinds if necessary and unloads said first workpiece while said second workpiece is being ground remotely by said second operator.

14. A grinding apparatus for grinding workpieces said apparatus comprising:

a frame;

a holder rotatably secured to said frame for releasably holding a first workpiece of the workpieces;

means for rotating said holder from a loading station to a grinding station;

grinding means movably secured to said frame and selectively positionable relative to the first workpiece when the first workpiece is located at said grinding station;

control means for selectively positioning said grinding means relative to the first workpiece for grinding the first workpiece;

a further holder rigidly secured to and spaced relative to said holder the arrangement being such that when said holder is rotated in a direction towards said grinding station said further holder is rotated in a direction towards said loading station for loading a second workpiece of the workpieces at said loading station so that sequential grinding and loading of the workpieces is permitted;

said frame including:

a base;

a first and a second sidewall extending upwardly from said base;

a grinder support extending between said sidewalls for supporting said grinding means;

said grinding means including:

a depending arm supported by said grinder support; said grinder support including:

a first and a second transverse rail, each rail extending between said sidewalls;

a carriage supported by and guided by said rails such that movement of said carriage between said sidewalls is permitted;

a screw and block mechanism mounted on said carriage such that said block supports said depending arm for permitting movement of said depending arm in a first direction between said sidewalls and in a second direction normal to said first direction; and lifting means connected to said depending arm for permitting vertical movement of said depending arm relative to said carriage so that movement of said depending arm to any location is permitted.

15. A grinding apparatus as set forth in claim 14 wherein said grinding means is rotatably secured to said depending arm.

* * * * *